United States Patent [19]

Tetherton

[11] Patent Number: 4,732,375

[45] Date of Patent: Mar. 22, 1988

[54] APPARATUS FOR HANDLING STRIP-LIKE MEDIA

[75] Inventor: Cyril F. Tetherton, Poway, Calif.

[73] Assignee: Cubic Western Data, San Diego, Calif.

[21] Appl. No.: 889,675

[22] Filed: Jul. 24, 1986

[51] Int. Cl.[4] ..... B65H 29/70

[52] U.S. Cl. ..... 271/176; 271/188; 271/209; 271/220; 271/303

[58] Field of Search ..... 271/188, 209, 220, 224, 271/176, 259, 303

[56] References Cited

U.S. PATENT DOCUMENTS

| | | | |
|---|---|---|---|
| 3,087,724 | 4/1963 | Snowdon | 271/188 |
| 3,139,278 | 6/1964 | Maidment | 271/188 |
| 3,595,565 | 7/1971 | Bergland | 271/188 X |
| 3,749,398 | 7/1973 | Fujita | 271/188 X |
| 3,918,700 | 11/1975 | Donner | 271/220 X |
| 4,223,885 | 9/1980 | Templeton | 271/220 |
| 4,251,000 | 2/1981 | Templeton | 271/188 X |
| 4,640,505 | 2/1987 | Placke | 271/209 |

*Primary Examiner*—Richard A. Schacher

*Attorney, Agent, or Firm*—Brown, Martin, Haller & Meador

[57] ABSTRACT

A handling apparatus for guiding paper money or other strip-like media into a storage area or cashbox includes a drive mechanism for driving the central longitudinal area of a strip-like element to follow a first curved path, and an opposing guide for simultaneously urging the outer longitudinal areas of the bill in directions transverse to the first path so that they follow curved paths which are different to the first path. This tends to pull or stretch the element simultaneously both along its central axis and transverse to that axis, which will tend to remove any previous deformation applied to the element prior to stacking. A guide surface guides the bill from the drive mechanism into the storage area, and is preferably movable when a bill is detected projecting out of the storage area to urge the bill into the storage area and to compress the stack of bills.

18 Claims, 9 Drawing Figures

APPARATUS FOR HANDLING STRIP-LIKE MEDIA

BACKGROUND OF THE INVENTION

The present invention relates to an apparatus for handling strip-like media such as currency notes, plastic cards and other deformable documents, and is particularly directed to an apparatus for transferring documents such as paper money or other paper or plastic strip-like media from an exit opening of a transporting device to a temporary storage area or cash box where stacking is required for maximum utilization of volume. Such an apparatus is used, for example, in fareboxes on public transportation systems, in change machines, and in other types of vending and media handling machines.

In public transportation systems a farebox will normally be located on the transport vehicle for receiving money or other payment media deposited by passengers in payment of fares. Such fareboxes may be designed for monitoring by the vehicle operator or may be designed to be fully automatic and provide the passenger with the appropriate farecard or ticket once the appropriate fare has been deposited. The farebox normally incorporates a coin module for receipt of money in the form of coins, and a bill module for receipt of money in the form of bills. The bill and coin modules transport the money for deposit in a suitable cashbox, also contained within the farebox, and may include detector systems for detecting the denomination of the deposited cash.

One problem in handling deformable strip-like media such as paper bills, notes, plastic cards, and the like in this fashion is that it is often torn, wrinkled, folded or rolled or bent prior to deposit in the farebox bill module inlet. Such deformations will be retained in the note or other strip-like element, and once it is deposited by means of gravity into the cashbox it will tend to revert to its crumpled, bent or folded shape, irrespective of any transformation that may be imposed on the media during its travel through the transporting device, with further deterioration in cases where the media transfer from transport module to cashbox is by powered rollers or belts. A cashbox will reach capacity relatively quickly and the system will have to be taken out of operation until the cashbox can be removed for emptying. This results in frequent servicing of the machine, and the farebox will often be out of order during normal transport operations. This is particularly so in cases where the media is inserted into the machine by the general public where repeated handling of bills or tickets will result in no two inserted configurations being the same.

SUMMARY OF THE INVENTION

It is an object of the present invention to provide a transport mechanism for strip-like media such as currency notes which can take notes which have been previously bent, folded or rolled and tends to flatten out such notes for more uniform and compact stacking in a suitable storage area.

According to the present invention an apparatus for handling strip-like media such as currency notes or other strip-like elements is provided, comprising a transport device for transporting notes between an inlet and an outlet, and a guide mechanism for guiding the notes from the outlet into a storage area where they are stacked flat one on top of the other. The transport device includes a deforming or reconfiguring device adjacent the outlet for either temporarily or permanently deforming the element to remove the memory of any previous deformation applied to the element, at least until it enters the storage area and is stacked. The deforming or reconfiguring device comprises a first guide means for driving the central longitudinal area of the note to follow a first curved path, and a second, opposing guide for simultaneously deforming the outer longitudinal areas on each side of the central area in directions transverse to the curved path and urging them to follow secondary curved paths different from the first path so as to deform the outer area of the note out of the plane of the central area. The curvature of the secondary paths is preferably different from that of the first path, so that the note or other strip-like element is simultaneously pulled or "stretched" in two perpendicular directions, both along its central axis and transverse to that axis, under the effect of the opposing guides which simultaneously urge different parts of the element to travel in different directions.

This effect is enhanced if the two guides are of materials having different coefficients of friction, causing the element to drag more along one surface than the other. Thus parts of the element will be held back by frictional engagement with the guide having the higher coefficient of friction relative to those parts engaging the other guide.

This stretching of the note or element will tend to flatten it and remove all memory of previous deformations such as bends, creases or curls, so that it can be stacked flat in a storage area. The amount of deformation applied by the reconfiguration device will depend on the apparatus in which it is to be used. Where it is used in an apparatus such as a farebox for receiving currency notes or the like from members of the public who may have significantly deformed the notes in different ways during handling, the device may be arranged to apply two longitudinal tracks or creases between the central area and two sides of the note where it is deformed between the opposing guides. In applications where the document or other strip-like element is likely to be less deformed initially, such as machines handling new or relatively new bank notes, the so-called reconfiguration may be applied only momentarily or in a semi-permanent manner in order to revert the material to its original flat condition at least until it is stacked within the storage area. The degree of reconfiguring deformation to be applied is determined by the spacing between the guides and the relative orientation of the guides.

The first guide may comprise a roller or stationary curved surface around which the central area of the element is passed. The second guide may comprise an opposing roller or surface having curved faces which are inclined relative to the first guide surface so as to bend the outer areas of the note out of the plane of the central area of the note.

In a particular arrangement the transport device comprises opposing belts between which the central area of a document is transported, and the first guide comprises a roller at the document exit around which one of the belts is passed. The second guide is an opposing roller having a central area around which the other belt is passed and annular rims projecting on opposite sides of the belt across the document path to engage the outer areas of a note passing along the belts.

In alternative arrangements the means for driving the central area of the note in the first, curved path may comprise rollers in opposed, pinch type configuration or a single driven roller or belt working in conjunction with an opposing fixed surface. The opposing guide for driving the outer areas of the note in a different direction may comprise either stationary or rotating opposing devices on each side of the first curved path.

The reconfiguring device may be integral with a bill or ticket transport mechanism for transporting such elements from an inlet to an exit adjacent a storage area, or may be an entirely separate device. The exit of the reconfiguring device is at an angle downwardly from the preferably directed direction and generally towards a storage area horizontal inlet. Thus, rather than falling into a storage area in a vertical orientation, where it is likely to be crumpled or crushed by subsequent documents, the document is guided at an angle towards the storage area. The note or other strip-like element is guided from the reconfiguring device along a suitable guide surface into a storage area or cash box inlet, where it will tend to fall flat onto the previously stored note. Thus, instead of curling up or bending when released from the transport mechanism into a cash box, the note will tend to be maintained in a flattened condition. This allows a significantly larger number of notes to be stored in a cashbox, increasing time between farebox servicing and allowing the farebox to remain in operation for extended periods.

According to a preferred feature of the invention, the guide surface is moveable to urge notes positively into the cash box, and to compact the stacked pile of notes so that a greater number of notes can be stored in the cash box. In one embodiment of the invention the guide surface is in the form of a curved plate movable between a first position in which it projects upwardly out of the cash box inlet and towards the transport mechanism outlet, and a second position in which the curved area of the plate projects downwardly into the box to contact the uppermost bill in a stack and to compress the stack. The bills will tend to travel along the curved plate surface into the cash box, and when the plate is actuated to move into the box it will tend to sweep any bill which is still projecting out of the cash box at that point with it into the cash box. The curved plate is preferably actuated in response to a sensor signal when a bill is detected to be stopped in the transport mechanism outlet or projecting upwardly out of the cashbox inlet.

Clearly this handling apparatus can be utilized not only in fareboxes but also in any machine designed to accept paper money or other relatively flimsy documents or striplike media and transfer such media into a storage area for stacking within a limited volume.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which.

DESCRIPTION OF THE PREFERRED EMBODIMENT

Figure 1:
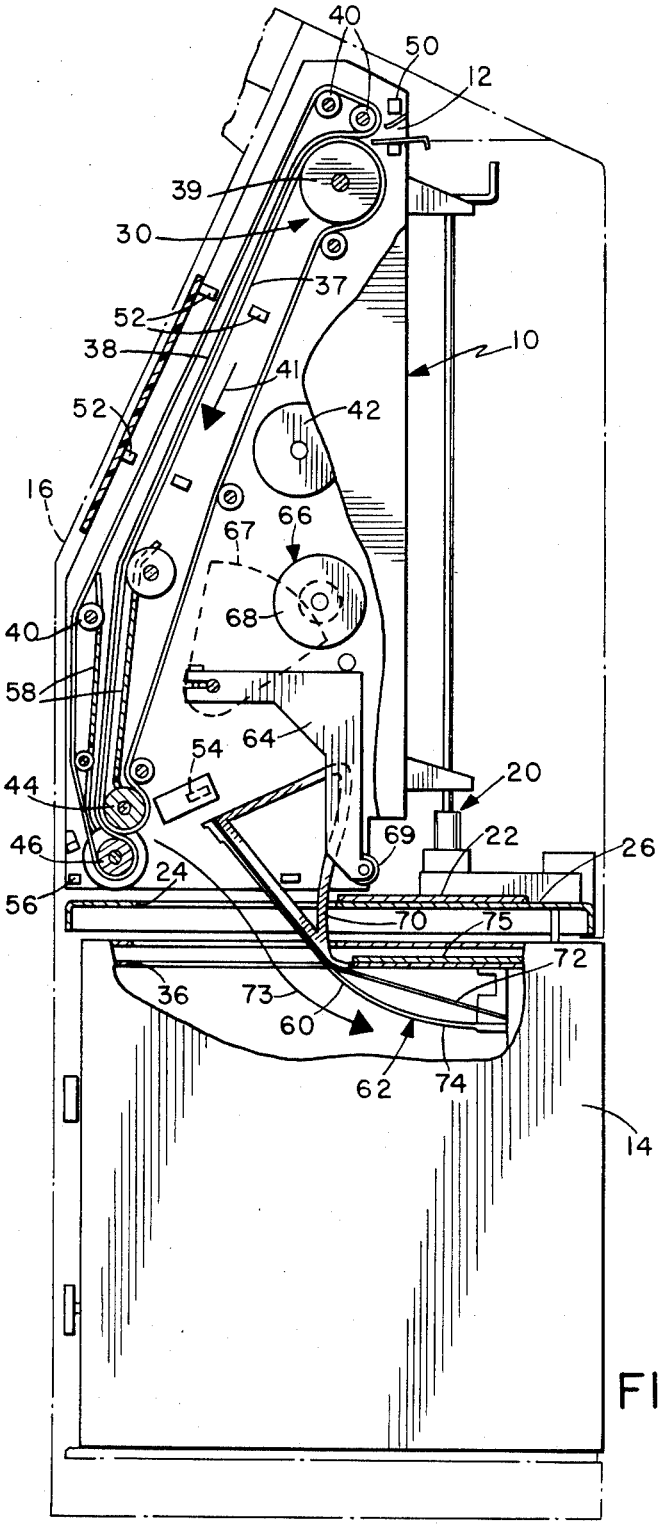
FIG. 1 is a side elevational view of a bill transport unit and cashbox incorporating a bill handling apparatus according to a preferred embodiment of the present invention, with portions cut away.
Figure 2:
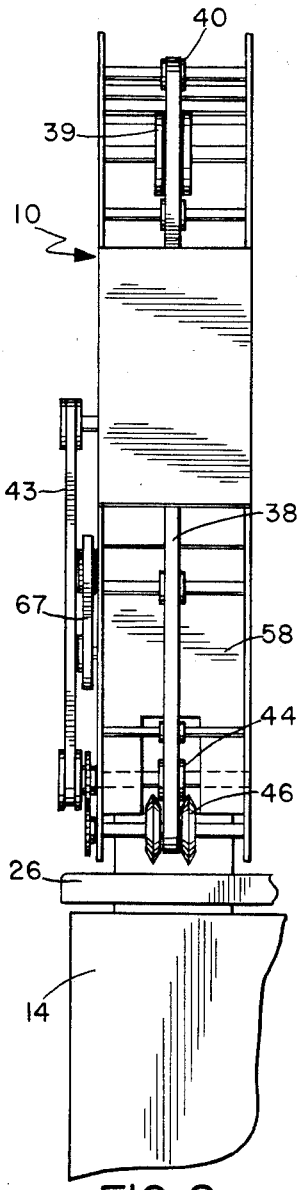
FIG. 2 is a view from the left side of FIG. 1.

The drawings show a typical embodiment of a bill transport and storage system incorporating a bill handling mechanism according to a preferred embodiment of the present invention for transferring bills or other strip-like media from a transport unit into a storage unit. The bill transport mechanism is in the form of a bill module 10 for transporting bills or other strip-like media such as fare cards, tickets or coupons from an inlet 12 into a suitable cashbox 14 at the lower end of the bill module, as best shown in FIG. 1. The bill module is contained in the outer housing 16 of a farebox suitable for use in a public transportation system, for example. Such a farebox is described, for example, in more detail in co-pending application Ser. No. 750,534 filed June 28, 1985 and entitled "Multi Fare Media Farebox", which is assigned to the same assignees as the present invention. The preferred embodiment of the present invention comprises a bill handling apparatus designed for use in that farebox, but it may alternatively be used in any apparatus in which deformable strip-like elements are transferred into a storage area for stacking.

Other parts of the farebox which are not described in detail in the present application and do not form part of this invention include a coin module located alongside the bill module 10 in the upper part of farebox housing 16 for discriminating between different denomination coins and carrying accepted coins into cashbox located in a lower area of the farebox housing. The cashbox may have separate compartments for coins and bills, or two separate cashboxes may be provided. Various security mechanisms, for example as described in more detail in co-pending application Ser. No. 750,534, are provided for ensuring that the coin module, bill module and cashbox cannot be removed in a manner allowing access to the interior of the cashbox, for example. The mechanism 20 for locking the bill module in the housing, for example, which is described in more detail in application Ser. No. 750,534, is linked to a security shutter 22 which automatically moves to cover an opening 24 in security plate 26 which separates the upper area of the farebox housing containing the bill and coin modules from the lower area of the housing containing the cashbox. This shutter 22 can only be opened by simultaneously locking the bill module into the housing, while the bill module can only be removed for servicing, for example, by unlocking mechanism 20 which simultaneously closes and locks shutter 22.

Although in the preferred embodiment of the invention the apparatus is used for handling and storing of paper money in a farebox, it may alternatively be used in any machine for handling paper money, such as a change or vending machine, or in machines for transporting and storing other types of documents.

The farebox may be located on a transport vehicle such as a bus, tram or train, or at a passenger loading and unloading area in a transportation system. It may also be designed to accept other payment media in addition to cash, such as prepaid farecards, tickets or tokens, as described in co-pending application Ser. No. 750,534 of Joseph L. Baker et al., filed on June 28, 1985.

The bill feeder or transport module 10 is shown in more detail in FIGS. 1 to 4. The module 10 comprises a transport mechanism 30 for moving bills along path 32 from inlet aperture 14 to a module outlet 34 positioned above the cashbox entry aperture 36. The transport mechanism basically comprises a pair of endless belts 37, 38 between which a bill is held and transported along the bill path 32 in a conveyor belt-like fashion. The belts 37 and 38 are each stretched around sets of rollers 39, 40, respectively, and driven to rotate in the direction of arrow 41 by means of a belt drive motor 42 which is connected via pulley drive belt 43 in a conventional fashion to one of the rollers of each set. However, alternative transport mechanisms such as opposed rollers may be used.

Located at the exit of the transport mechanism is a deforming or reconfiguring assembly 45 according to a preferred embodiment of the present invention. In the preferred embodiment of the invention this assembly forms part of the transport mechanism 30, but it may alternatively be completely separate from mechanism 30 and have its own drive means.

The assembly 45 basically comprises a pair of opposed rollers or guides 44, 46 between which a bill or other strip-like element 48 is driven. The two belts 37 and 38 pass around the first roller 44 and the central area of the second roller 46, respectively and the opposing central areas of rollers 44 and 46 comprise a guide assembly defining a first curved path along which the central longitudinal area 101 of the note 48 is driven out of the exit (see FIGS. 3 and 4.) As best shown in FIG. 4, the roller 46 has a pair of spaced annular rims or ridges 49, one at each axial end of the roller, which project across the ticket path on each side of the guide belts 37 and 38, and on each side of the other roller 44. The rims 49 act to deform the outer areas of a bill 48 passing between them with its central area gripped between the two belts 37 and 38 in directions transverse to the first curved path, as shown in FIG. 4. Thus the bill is bent upwards at each side of its central area around rims 49.

At the same time, the rims 49 define secondary curved guide surfaces along which the outer areas of the note are guided, these surfaces having a different curvature to the primary curved path defined between the opposed central areas of rollers 44 and 46. Thus the bill will be simultaneously urged along different curved paths in different areas, which tends to pull or "stretch" the bill both along its central axis and in a direction transverse to that axis, since it will be traveling at different relative speeds along the different paths, i.e. different parts of the bill will be simultaneously urged in different directions. This has been found to reconfigure the bill or any strip-like element of the same general nature in a manner which tends to remove any previous deformations such as bends, rolls, folds or creases.

Figure 3:
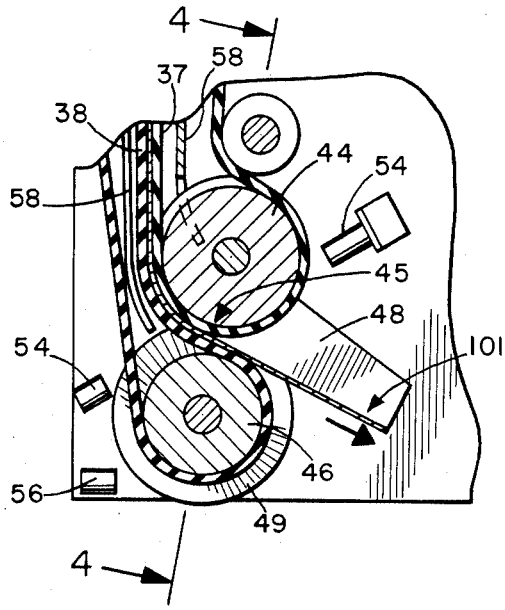
FIG. 3 is an enlargement of a portion of FIG. 1, showing the bill handling apparatus at the exit of the transport unit.
Figure 4:
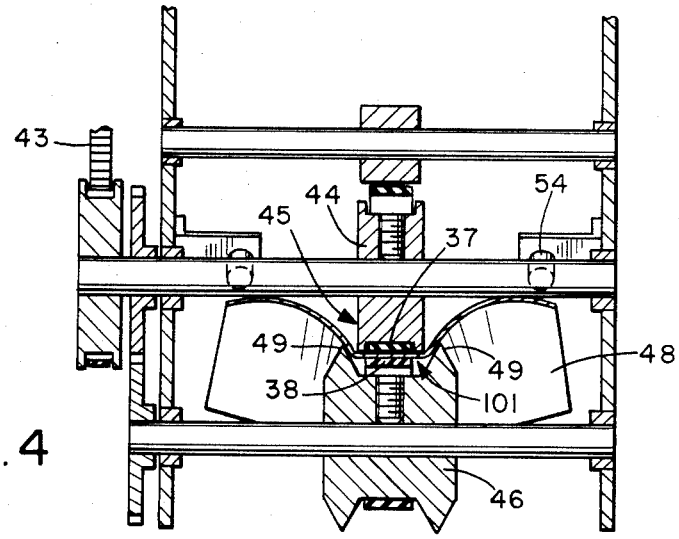
FIG. 4 is a sectional view taken on the line 4—4 of FIG. 3.
Figure 5:
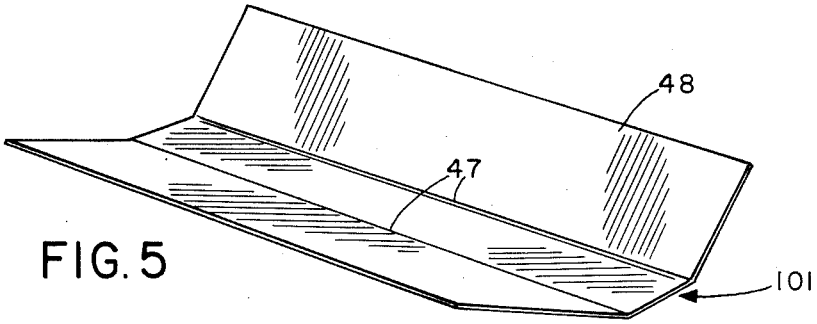
FIG. 5 is a perspective view of a bill or other document showing the creased configuration when leaving the bill transport unit.

In the arrangement shown in FIGS. 3 to 5, the opposed rollers 44 and 46 between which the bill is driven tend to apply permanent or semi-permanent creases 47 along the length of the bill where it is bent up on each side of the central area. This is desirable where a large amount of prior deformation is likely to have been applied, as will be the case with paper money or other strip-like media has been handled by the general public. However, in other applications where a lesser degree of prior deformation is likely, the element may be reconfigured only momentarily while passing through the assembly 45 so that it is flattened sufficiently for stacking, for example by having a greater spacing between the opposed faces of roller 44 and rims 49 and having the rims 49 inclined at a less steep angle.

Although in the illustrated embodiment the first curved path is defined between opposed belts and the secondary curved paths are defined by the opposed rims of a roller, various alternative configurations of the opposing guide surfaces are possible. Thus, the central area of the note may be driven along the first curved path by means of opposed rollers or a single roller or belt acting in conjunction with an opposing, fixed surface. Similarly, the secondary guides for deforming the outer areas of the note may comprise stationary curved guide surfaces inclined at an appropriate angle to the primary path, rather than one or more rollers.

The two rollers 44 and 46 are preferably of materials having different coefficients of friction, such as metal and plastics material, for example. This is found to have an improved stretching or reconfiguring action due to the dragging of different parts of the note across surfaces of different friction coefficients. The outer roller 46 is preferably of nylon or other plastic material and preferably has rims of generally V-shaped cross section, as indicated in the drawings. The gap between the opposed surfaces of the rollers is sufficiently greater than the note thickness that the note is not actually pinched between the rollers but is simply stretched or deformed in its areas passing between the opposed surfaces. This helps to reduce the risk of notes jamming up at the crimping rollers. With elements having a thickness of the order to 0.005 inches, such as currency notes for example, a separation of the order of 0.08 inches between rims 49 and roller 44 has been found to be suitable.

The overall control of the transport mechanism is carried out by a series of optical sensors provided at various stages in the bill path, which are linked to a suitable control circuit (not shown) which is mounted on a suitable logic or printed circuit board within the bill module or farebox housing for controlling operation of the transport mechanism and of the handling apparatus of this invention. The operation of the control circuit linked to the sensors is described in more detail below with reference to the block flow diagram of FIG. 9. The control circuit may include means for controlling operation of other parts of the farebox assembly, as described in co-pending application Ser. No. 750,534, or may be designed for control of the bill module alone.

A first pair of sensors 50 is located at the bill module inlet detect deposit of a bill and actuate the belt drive motor 42 to rotate the belts and guide the bill along path 24. Optical sensors 52 are located along the bill path and comprise part of a bill measurement system to detect whether the deposited bill is a currency note or another strip-like document, such as a farecard or ticket, for example. Such a system is described in more detail in copending application Ser. No. 750,534, referred to above. The transport system may include other bill validation equipment in alternative embodiments.

A pair of bill outlet sensors 54 are located at the rollers 44, 46 to detect a bill leaving the rollers, and a pair of cashbox entry sensors 56 are located at the bill module outlet to detect a bill leaving the bill module to enter the cashbox. All of the pairs of optical sensors are of a conventional type for detecting when a bill is present between them, blocking the optical path.

Figure 8:
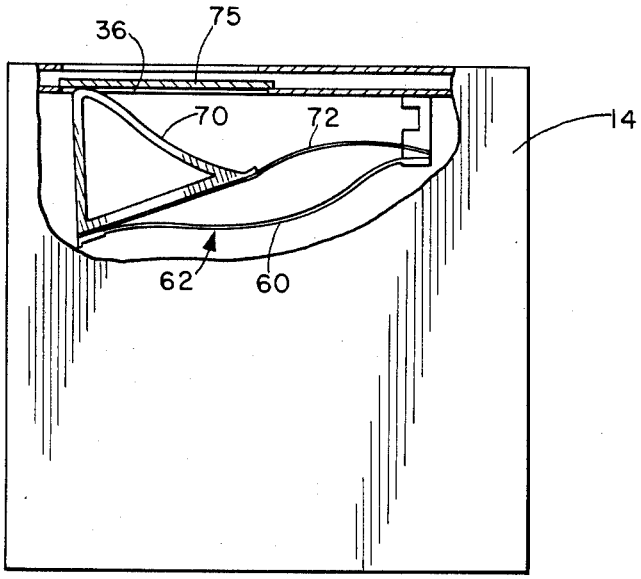
FIG. 8 is a view similar to FIG. 6 showing the cashbox closed and locked with the bill guide assembly fully retracted into the cashbox.

Suitable stationary guide surfaces 58 are provided along the bill path 32 to guide bills along the path to the outlet 34. At outlet 34 a further guide surface 60 extends generally from the bill path exit into cash box 14 to guide bills from the bill handling or reconfiguring assembly 45 into the cash box. The guide surface in the preferred embodiment is a curved plate mounted on a compactor member 62 which is moveable between a first, extended position as shown in FIG. 1 in which it projects out of the cash box and into the bill module outlet, and a second position in which it is within the cashbox as indicated in FIG. 8.

The compactor member is urged between its first and second positions by means of an actuator ram 64 which is operated by a suitable drive mechanism 66 such as a pulley drive or gear wheel mechanism 67 driven by motor 68. On operation of motor 68, a roller 69 at the free end of ram 64 engages a cam surface 70 on compactor device 62 and rides along the cam surface to urge the compactor device downwardly through cash box inlet 36. Preferably, the compactor device 62 comprises a spring plate or includes other means for urging it towards the first position shown in FIG. 1, such that it automatically moves back into its extended position when the ram is retracted.

Figure 6:
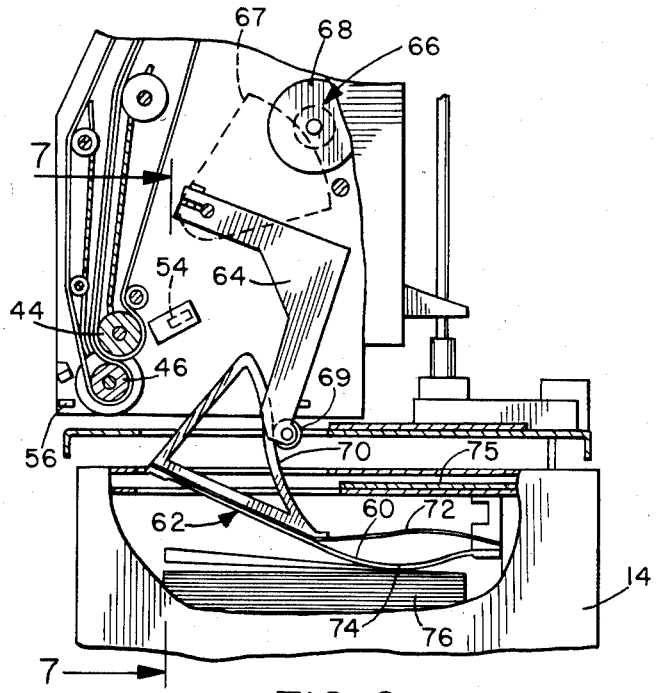
FIG. 6 is view similar to a portion of FIG. 1, showing the ram action for urging the bill guide assembly into the cashbox.

In the preferred embodiment illustrated in FIGS. 1 and 6 to 8, the guide surface 60 along which a bill or note travels comprises a curved resilient plate of nylon, plastics material or the like which is secured at each end to a spring steel mounting plate 72 and is longer than the mounting plate such that it bows outwardly from it as indicated in the drawings when the steel plate is compressed by the ram action. As the compactor device or assembly is urged between the first and second positions, the plate will bow out even more from the mounting plate as indicated in FIG. 6.

When the compactor device is in the extended position shown in FIG. 1, the curved plate 60 forms an arcuate guide surface extending from the reconfiguring assembly outlet through the cash box inlet and into the cash box. Bills leaving the module will therefore tend to follow this guide surface in the direction of arrow 73 in FIG. 1 and enter the cash box in a generally horizontal orientation, each bill being inclined slightly downwardly at its forward edge following curvature at the outlet of rollers 44 and 46 and the inclination of the bowed portion 74 of the guide surface within the cash box. This has been found to be an optimum direction of entry of bills into the cash box, to avoid the tendency of the forward end of each bill entering the box to curl up and resist stacking. Thus, rather than dropping vertically downwardly into a cashbox opening of the same size as the bill or being rammed vertically downwardly as was done in the past, bills are guided into the cashbox with the forward end of each bill entering the cash box first and being guided at a downward inclination as shown into a generally horizontal orientation. This has been found to provide much improved stacking of bills one on top of the other, so that a much larger number of bills can be stacked in a cashbox of the same overall dimensions.

The cash box opening also has a conventional slide plate 75 for closing and locking the opening when the box is full. Plate 75 is operated by a suitable actuator handle (not shown), as described in more detail in copending application Ser. No. 750,534, and will also act to draw compactor member into the cash box as the opening is closed, as best shown in FIG. 8.

Figure 7:
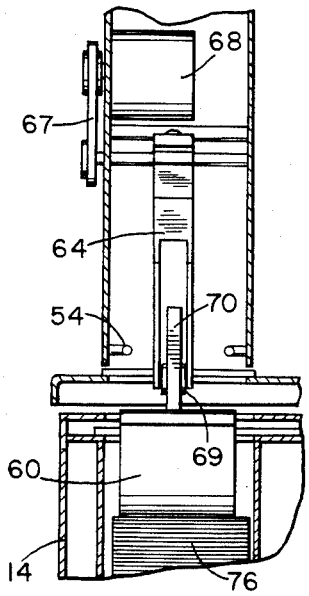
FIG. 7 is a sectional view taken on the line 7—7 of FIG. 6.

In the preferred embodiment of the invention the cashbox 14 is the same as described in co-pending application Ser. No. 750,534, apart from the addition of the guide and compactor device 62 which is mounted at one end within the cashbox at the side of the cashbox remote from inlet opening 36, as shown in FIGS. 6, 7 and 8, so that the free end of the guide plate 60 and mounting plate 72, together with wedge-like cam 70, normally project upwardly out of the opening 36 as shown in FIG. 1 and towards the exit of guide rollers 44 and 46.

The combination of the reconfiguring device for stretching or reconfiguring a bill, together with the curved guide surface for guiding bills into the cash box in a generally horizontal orientation, significantly improves the storage capacity of bills within a farebox. The creasing of the bill by the reconfiguring device as described above is preferably retained to a certain extent after the bill leaves the rollers 44 and 46, tending to strengthen and flatten the note so that even old, thin notes, or prerolled, folded or creased notes will tend to straighten out into a relatively flat condition for stacking in the cash box. Thus the tendency for notes which have previously been rolled, bent or folded by a passenger to curl or bend up in the cashbox, taking up a much greater space than is necessary, is reduced or avoided in this apparatus.

The curved guide surface will guide the creased note into the cashbox at a downwardly inclined angle, reducing the tendency of the forward end of the note to curl up as it enters the box and orientating bills in a generally horizontal direction for forming a relatively uniform stack in the cash box. If a bill is detected to be stuck at the bill module outlet, the compactor device is driven between its first and second positions, with the guide surface following a curved path travelling from left to right in the cashbox as viewed successively in FIGS. 1,6 and 8 to sweep the jammed note in the same general direction into the cash box. The curved surface will then press down on the resultant stack of bills 76, acting to compress or compact the stack and leave space for more bills to enter the box.

Thus when the cash box is relatively empty the guide surface will remain stationary as bills enter the box and stack up one on top of the other. When the top of the stack approaches the top of the cash box, a bill may stick at the cash box inlet, projecting upwardly out of the cash box and into the bill module outlet. This condition will be detected by outlet or cashbox entry sensors 56, resulting in actuation of compactor member to drive the bill into the cashbox and compress the stack.

Figure 9:
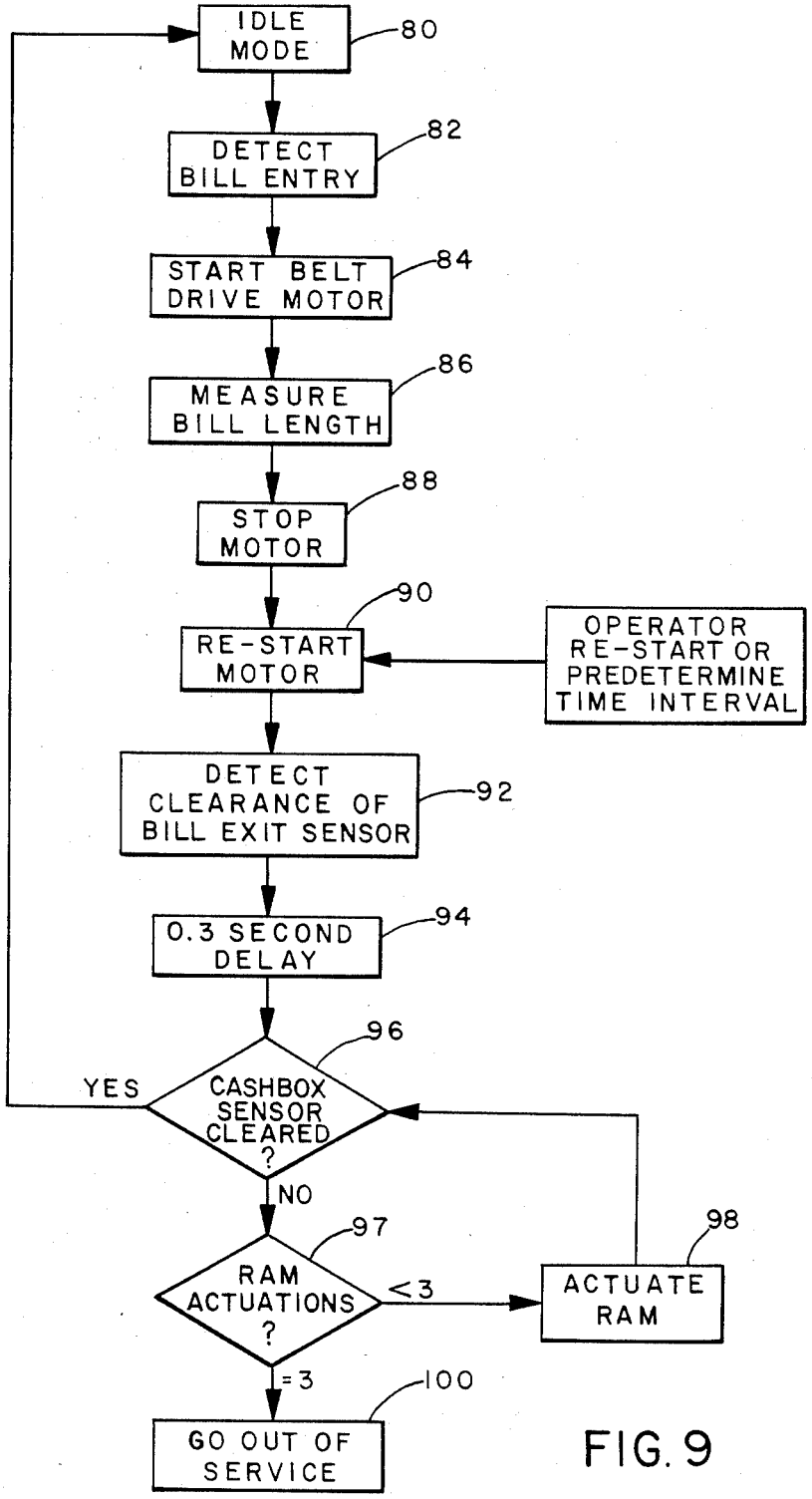
FIG. 9 is block function diagram of the operation of the transport and storage system.

Operation of the bill transport and storage mechanism described above will now be described in more detail with reference to the block flow diagram of FIG. 9. It will be understood that a suitable control circuit linked to the various optical sensors and drive motors will be provided for operation of the system, which may suitably be microprocessor controlled for recognition of the various sensor signals and subsequent operation of the transport and storage mechanism in the manner shown generally in FIG. 9.

The bill module control circuit will initially be in a so-called "IDLE MODE" 80 in which the input sensor 50 is polled at regular intervals by the microprocessor provided on the farebox logic or PC board (not shown), looking for a blockage of this sensor indicating entry of a bill or other document such as a farecard or ticket. When a bill is detected at sensor 50 (step 82), the transport motor 42 is started (84) and the bill is moved along with belts 37, 38 until the first pair of bill length sensors 52 are blocked. This starts a bill length measurement sequence (step 86). While sensors 52 remain blocked, another sensor (not shown) counts the holes in an encoder wheel attached to the transport motor 42 until the sensor 52 is unblocked, when the motor is stopped (step 88). The total count of holes indicates the length of the bill or other document, which is used by the farebox processor to discriminate currency bills from coupons, farecards or tickets, which may also be transported by the bill module. Alternatively, the discrimination may be performed by spaced pairs of sensors in the bill path, such that both sensors are covered simultaneously at one point if the document is the length of a standard currency note whereas only one is covered if the document is of shorter length, such as a ticket. The note is preferably stopped at a transparent window visible to a vehicle driver or other operator, as in application Ser. No. 750,534, to allow the operator to confirm the value of the note.

After a predetermined period, or on direct driver intervention, the transport motor 42 is restarted (step 90) and the bill is transported down along the bill path and between the rollers 44, 46 at the bill path exit. Here two creases are formed along the bill, as described above, as it follows a generally curved path, and the bill leaves the bill module and enters the cashbox, guided along guide surface 60 into the correct orientation for uniform stacking in the cashbox. Under normal conditions, the bill will fall into the cashbox with no assistance after clearing the last drive roller. This is checked by means of the bill exit sensors 54 at rollers 44,46 and the cashbox entry sensors 56. As soon as the bill exit sensors 54 are cleared (step 92), a timer is started and after a 0.3 second delay (step 94), the cashbox entry sensors 56 are checked (96). If the sensors 56 are still blocked at this time, a bill will be stuck at the cashbox entry. This normally happens when the cashbox is almost full so that the front end of the entering bill is stuck against the top of the stack.

If the processor determines that this condition is met, the ram actuator motor 68 is operated to drive the quarter gear wheel 67 which is linked to ram 64, urging the free end of ram 64 in an arc to the left as viewed in FIGS. 1 and 6. The roller 69 will ride up along wedge-like cam surface 70 to the left, simultaneously urging the compactor device 62 downwardly and to the right as viewed in FIG. 6. This will act to sweep any bill projecting upwardly out of the cashbox at that time into the cashbox, the bill being pulled along with guide surface 60 in a direction generally from left to right as viewed in FIG. 6. Thus rather than pushing a bill vertically downwardly into the cash box, which could result in crumpling or creasing of the bill, the compactor device of this invention sweeps a bill into the cashbox in a generally horizontal direction so that it will tend to enter the cashbox in the correct orientation for uniform stacking on the top of a stack of bills inside the cashbox. The bowed spring guide plate 60 will press down on the top of the stack, starting at the left hand side and sweeping across to the right, tending to compress the stack to leave additional space at the top of the cashbox for supply of additional bills to the cashbox.

The motor 68 is then reversed, retracting arm 64 to the position shown in FIG. 1. Compactor device is urged by spring mounting plate 72 back into its first position shown in FIG. 1. At this point the last bill to enter the box should remain within the cashbox. However, if the box is completely full, actuation of the compactor member will not unblock the bill module outlet since each time the member is retracted the bill will pop back up out of the cash box. Thus, if the compactor member is actuated a certain number of times, for example three times in a row, without unblocking the outlet or cashbox entry sensors (steps 97 and 98), a "GO OUT OF SERVICE" signal (100) is initiated. The cashbox is declared full, and the transport mechanism can then no longer be actuated to transport additional bills into the farebox, i.e. the start sensor is ignored by the farebox processor until the cashbox is removed or is overridden by the driver. A suitable indicator on the front of the farebox is preferably lit to indicate that the farebox is out of service. The bill transport is also stopped by the processor while the ram is operating to prevent a bill from being driven down on top of the ram and cashbox entrance guide, which could otherwise cause a jam.

When the system goes out of service after detection of blocking of the cashbox entry sensors for three successive actuations of the ram, the cash box must be removed, emptied, and replaced. A suitable interlock mechanism (not shown) ensures that the cashbox cannot be removed without first moving the slide or shutter across the cash box opening or openings. The front edge of the slide will contact the cam surface 70 at the same time, drawing the compactor member into the cash box and pulling any projecting bill completely into the cash box. The cash box slide is automatically locked when closed and can only be reopened by service personnel having the necessary key.

It will be understood that this control system is designed for incorporation into an overall farebox control system, and alternative mechanical or electronic means for operating the compactor may be used in other applications.

The apparatus of this invention significantly improves bill storage capacity in a fixed storage area such as a cashbox bill compartment. It can be applied to any mechanism where flat, strip-like media are to be transported one by one for storage in a stacked condition, such as vending machines, change machines, fareboxes, and so on. The tendency for relatively flimsy paper or other material to curl up or fold when released into a cashbox or storage area, resulting in uneven stacking, is significantly reduced or avoided in this system by the addition of strengthening creases along the length of the note to strengthen and flatten it, and by the guide surface which guides the note in an inclined path into a generally horizintal orientation in the cash box. Stacking capacity is further improved by the compactor which sweeps noted forward into the cashbox and then compresses the stack. It has been found that with this apparatus a cash box which would previously hold only 400 notes can hold up to 1200 or more notes.

This apparatus can also handle notes which are still folded on entering the bill module. Creases will be formed on the folded note, tending to cause it to lie flat on top of the stack when entering the cash box.

Although a preferred embodiment of the invention has been described above by way of example only, it will be understood by those skilled in the field that modifications may be made to the disclosed embodiment without departing from the scope of the invention, which is defined by the appended claims.

I claim:

1. A handling apparatus for transferring strip like elements into a storage area for stacking one on top of the other, comprising:

first guide means for guiding the central longitudinal area of a strip-like element in a first curved path;

drive means for driving the central area of the element along the first curved path;

second guide means opposing the first guide means for guiding the outer area of the element on opposite sides of the central area to follow curved paths different from the first path and for deforming the outer areas of the element out of the plane of the central area;

the first and second guide means defining an exit opening through which the element is released;

storage means having an entry opening for receiving strip-like elements from the exit opening of the first and second guide means;

a guide member moveable between a first position extending from the entry opening of the storage means towards the guide means exit opening for guiding elements from the exit opening into the storage area in a generally downwardly inclined path and a second position within the storage area to urge elements into a stacked condition within the storage area.

2. The apparatus of claim 1, wherein the first and second guide means comprise opposed rollers, one of the rollers having annular rims projecting across the first curved path defined between opposed central areas of the rollers for deforming the outer areas of a document passed between the rollers.

3. The apparatus of claim 2, wherein the drive means comprises means for rotating at least one of the rollers.

4. The apparatus of claim 2, wherein the drive means comprises opposed belts passing around the central areas of the opposed rollers, and means for driving the belts to move the central area of an element gripped between the belts along the curved path.

5. The apparatus of claim 1, wherein the guide member comprises a curved resilient plate.

6. The apparatus of claim 5, wherein the plate is secured at one end within the storage area, the guide member further including bias means for urging the plate into its first position projecting out of the storage area.

7. The apparatus of claim 6, further including actuator means for moving said guide member between its first and second position in response to detection of a note stuck at the storage area inlet.

8. The apparatus of claim 7, further including first sensor means for detecting an element projecting out of the storage area inlet, second sensor means for detecting an element leaving the guide means exit opening, and means for operating said actuator means if said first sensor means detects an element at a predetermined time interval after said second sensor means is actuated.

9. The apparatus of claim 5, including a resilient mounting member, said plate being secured at opposite ends to said mounting member, said plate being longer than said mounting member such that it bows outwardly from it to form a curved guide surface.

10. The apparatus of claim 7, further comprising cam means projecting from said guide member, said actuator means comprising means for engaging said cam means to urge said guide member in a downwardly curved path between said first and second positions.

11. The apparatus of claim 1, wherein said second guide means has a surface having a higher coefficient of friction than said first guide means.

12. The apparatus of claim 11, wherein said second guide means is of plastic material.

13. A bill handling system, comprising:

a storage member having an inlet for receiving strip-like documents and an internal storage area for storing said documents in a stack;

a transport mechanism for transporting documents in a predetermined path;

a curved guide member moveable in an arced path between a first position projecting out of said storage area inlet towards the transport mechanism for directing documents from said transport mechanism in a generally downwardly inclined horizontal orientation into the storage area, and a second position within the storage area to urge elements into a stacked position within the storage area; and actuator means for moving the guide member between said first and second positions.

14. The apparatus of claim 13, wherein the guide member comprises a curved spring plate.

15. The apparatus of claim 14, further including a resilient mounting plate for said spring plate, said spring plate being longer than said mounting plate and being secured at opposite ends to said mounting plate so that it bows outwardly from it.

16. The apparatus of claim 15, wherein said mounting plate comprises means for urging said spring plate towards said first position.

17. A handling apparatus for transferring strip-like elements into a storage area for stacking one on top of the other, comprising:

first guide means for guiding the central longitudinal area of a strip-like element in a first curved path;

drive means for driving the central area of the element along the first curved path;

second guide means opposing the first guide means for guiding the outer areas of the element on opposite sides of the central area to follow curved paths different from the first path and for deforming the outer areas of the element out of the plane of the central area;

the first and second guide means defining an exit opening through which the element is released;

storage means having an entry opening for receiving strip-like elements from the exit opening of the guide means;

third guide means for urging an element into a stacked position within the storage area;

sensor means for detecting an element stuck at the storage area inlet; and means for operating said third guide means if said sensor means detects an element stuck at the storage area inlet.

18. A handling apparatus for transferring strip like elements into a storage area for stacking one on top of the other, comprising:

first guide means for guiding the central longitudinal area of a strip-like element in a first curved path;

drive means for driving the central area of the element along the first curved path;

second guide means opposing the first guide means for guiding the outer area of the element on opposite sides of the central area to follow curved paths different from the first path and for deforming the outer areas of the element out of the plane of the central area;

the first and second guide means defining an exit opening through which the element is released;

storage means having an entry opening for receiving strip-like elements from the exit opening of the first and second guide means;

a guide member moveable between a first position extending from the entry opening of the storage means towards the guide means exit opening for guiding elements from the exit opening into the storage area in a generally downwardly inclined path and a second position within the storage area to urge elements into a stacked condition within the storage area, the guide member comprising a curved resilient plate secured at one end within the storage area and bias means for urging the plate into its first position projecting out of the storage means;

actuator means for moving said guide member between its first and second position in response to detection of an element stuck at the storage area inlet;

first sensor means for detecting an element projecting out of the storage area inlet;

second sensor means for detecting an element leaving the guide means exit opening; and means for operating said actuator means if said first sensor means detects an element at a predetermined time interval after said second sensor means is actuated.

* * * * *